US006644966B1

(12) United States Patent
Chiang

(10) Patent No.: US 6,644,966 B1
(45) Date of Patent: Nov. 11, 2003

(54) CARRIAGE FOR SUPPORTING OBJECTS TO BE HEATED BY KILN

(75) Inventor: Chuan Chin Chiang, Chong Ho (TW)

(73) Assignee: Bell New Ceramics Co., Ltd., Taipei Hsien (TW)

( * ) Notice: Subject to any disclaimer, the term of this patent is extended or adjusted under 35 U.S.C. 154(b) by 0 days.

(21) Appl. No.: 10/191,243

(22) Filed: Jul. 3, 2002

(51) Int. Cl.[7] ..... F27D 5/00
(52) U.S. Cl. ..... 432/253; 432/88
(58) Field of Search ..... 432/88, 253, 261; 211/49.1, 123, 182

(56) References Cited

U.S. PATENT DOCUMENTS 3,698,698 A * 10/1972 Kreider et al. ..... 432/253
3,739,921 A * 6/1973 Schmidt ..... 211/194
4,227,874 A * 10/1980 Nugent ..... 432/261
5,836,760 A * 11/1998 Turner et al. ..... 432/253
5,848,890 A * 12/1998 McCormick ..... 432/261

* cited by examiner

*Primary Examiner*—Gregory Wilson
(74) *Attorney, Agent, or Firm*—Troxell Law Office PLLC

(57) ABSTRACT

A carriage includes two or more beams each having a number of orifices for receiving a number of rods and for allowing the rods to be retained between the beams for supporting the objects to be heated by the kilns or furnaces. The beams each includes two end bulges each having a groove for receiving two ends of two bars, and for forming a stable supporting structure. The beams each includes a lower cavity and an upper projection for engaging with each other and for allowing the beams and the carriages to be superposed or piled with each other.

4 Claims, 4 Drawing Sheets

CARRIAGE FOR SUPPORTING OBJECTS TO BE HEATED BY KILN

BACKGROUND OF THE INVENTION

1. Field of the Invention

The present invention relates to a carriage, and more particularly to a carriage for supporting objects to be heated by kilns or furnaces.

2. Description of the Prior Art

Typically, the objects to be heated or sintered by kilns or furnaces will be supported on planar carriages, and then moved into the kilns or furnaces by the carriages, and will then be heated or sintered together with the carriages. The typical carriages are normally made of china or porcelain materials, and will be easily broken after the heating or sintering processes, and/or due to carrying the heavy objects to be heated or sintered. In addition, the planar carriages may not be stably stacked with each other, such that the objects may not be stably supported by the carriages when a number of carriages are stacked with each other.

The present invention has arisen to mitigate and/or obviate the afore-described disadvantages of the conventional carriages.

SUMMARY OF THE INVENTION

The primary objective of the present invention is to provide a carriage for stably supporting objects to be heated by kilns or furnaces.

The other objective of the present invention is to provide a carriage having an increasing working life.

In accordance with one aspect of the invention, there is provided a carriage for supporting objects to be heated by kilns or furnaces, the carriage comprising a pair of beams each including a plurality of orifices formed therein, and a plurality of rods engaged through the orifices of the beams and retained between the beams for supporting the objects.

The beams each includes two ends each having a groove formed therein, the carriage further includes a pair of bars each having two ends engaged with the beams, and each having an extension extended from each of the ends thereof and engaged into the grooves of the beams. The beams each includes two ends each having a bulge extended upwardly therefrom, and having the groove formed in the bulges and facing upwardly for receiving the extensions of the bars.

The beams each includes a lower portion having a cavity formed therein, and an upper portion having a projection extended upwardly therefrom for piling purposes. The beams each preferably includes a swelling having the projection extended upward from the swelling.

One or more further beams may further be provided and each includes a plurality of orifices formed therein for receiving the rods, the rods may thus be threaded through the orifices of the other beams for allowing the other beams to be engaged onto the rods, to form a solid supporting structure.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
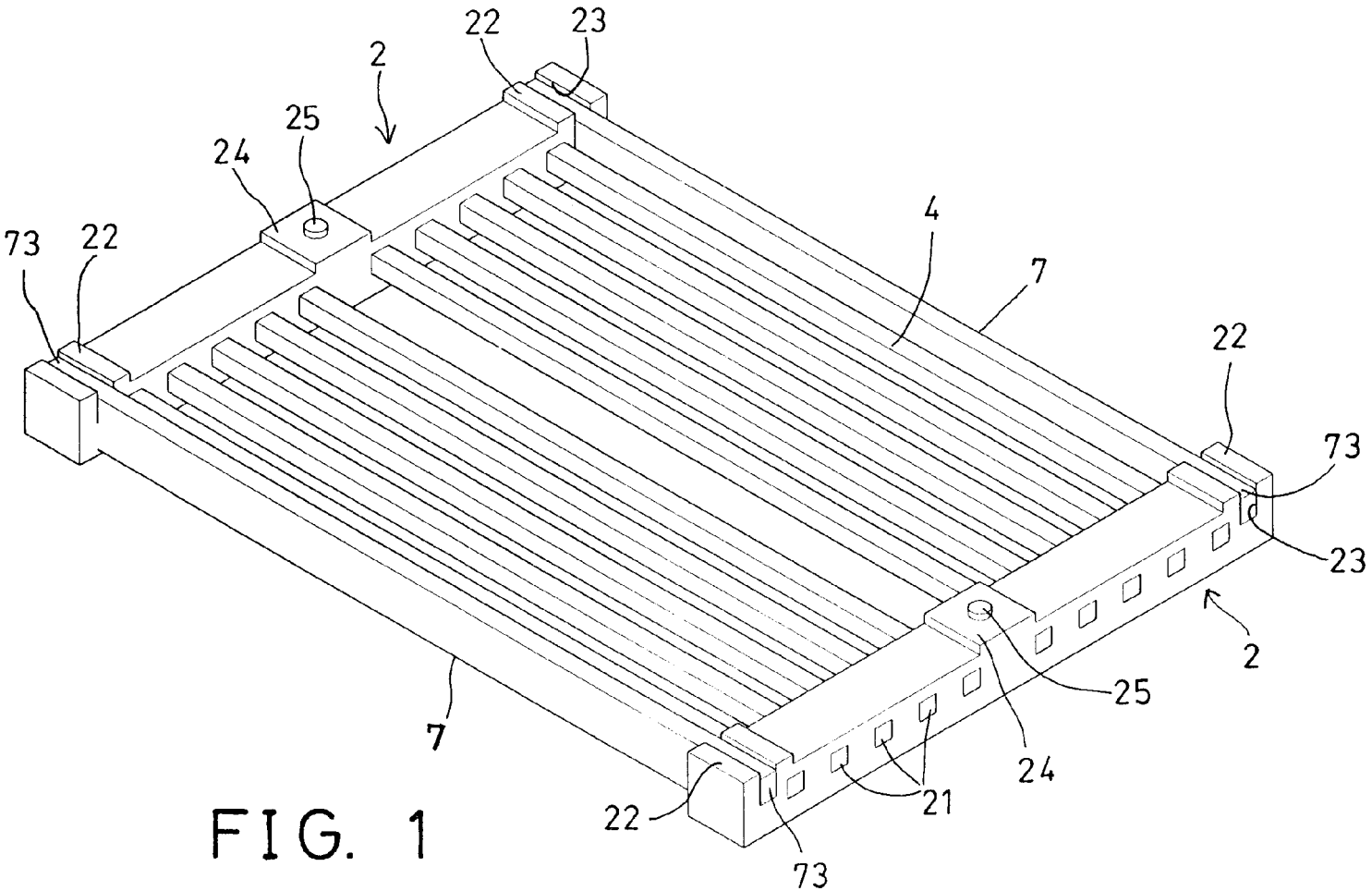
FIG. 1 is a perspective view of a carriage.
Figure 2:
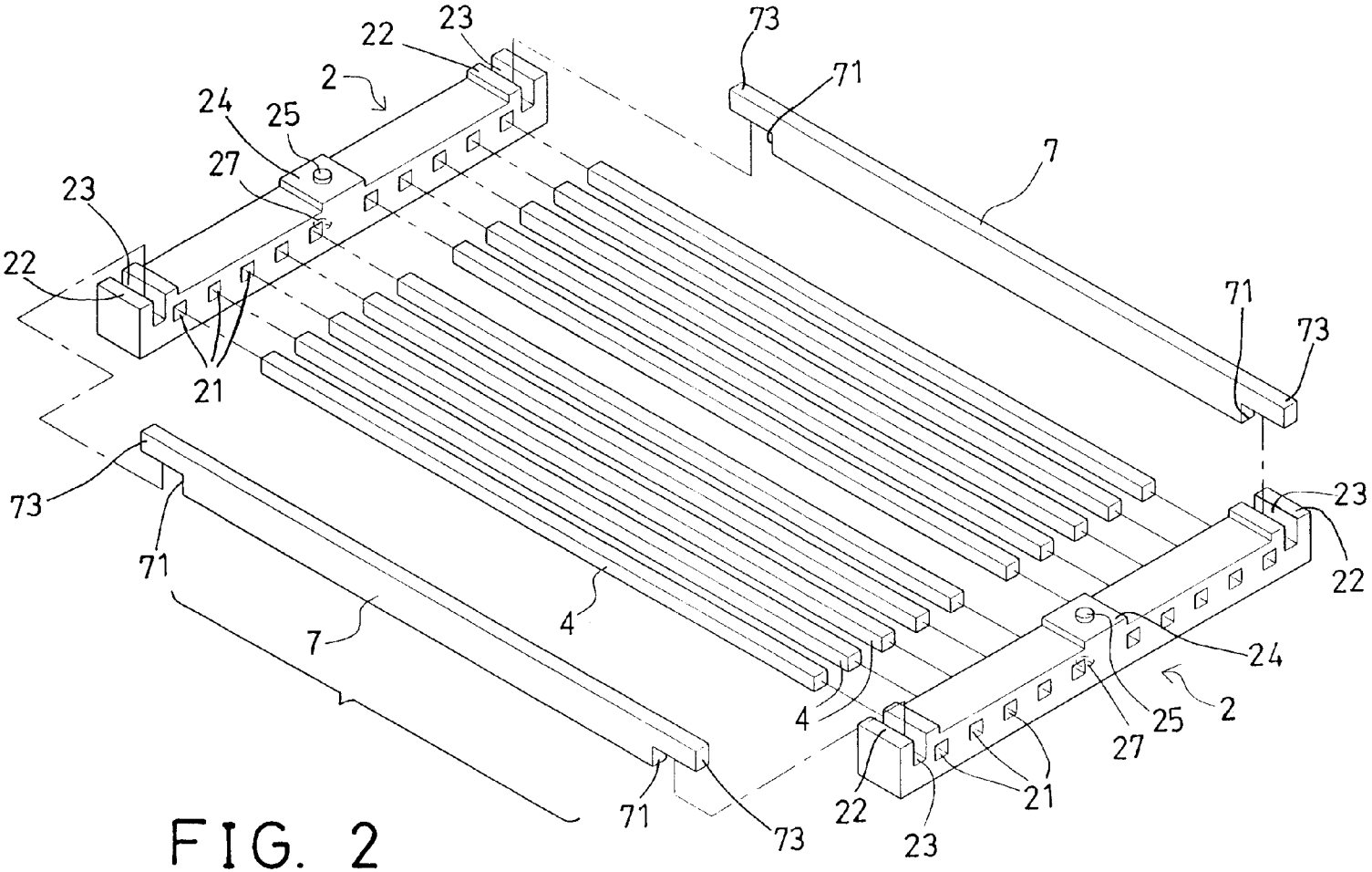
FIG. 2 is an exploded view of the carriage.

Referring to the drawings, and initially to FIGS. 1 and 2, a carriage in accordance with the present invention is provided for supporting such as the objects 8 or 9 (FIG. 3) to be heated by kilns or furnaces, and comprises two beams 2 each including a number of orifices 21 formed therein, and a number of rods 4 engaged into the orifices 21 of the beams 2 with such as a force-fitted engagement, or the like.

The rods 4 and the orifices 21 of the beams 2 are shown to have a square or rectangular cross section. However, the rods 4 and the orifices 21 of the beams 2 may also be formed into various or different cross sections, such as the circular cross sections, or the other non-circular cross sections.

The beams 2 each preferably includes a bulge 22 formed or provided or extended upward from each of the two ends thereof for such as reinforcing purposes, and each preferably includes a groove 23 formed or provided in each of the two ends thereof and facing upwardly. The bulges 22 may thus be slightly extended upwardly beyond the upper portion of the beams 2 respectively.

A pair of bars 7 include two ends 71 engaged with the beams 2, such as engaged with the inner sides of the beams 2, and each includes an extension 73 extended outwardly from each of the ends 71 thereof for engaging into the grooves 23 of the beams 2 respectively with such as a force-fitted engagement. The bars 7 may include a height greater than that of the rods 4, for forming two side walls for the carriage.

The beams 2 each may further include a swelling 24 formed or provided or extended upward from the middle portion thereof, and having a projection 25 extended upwardly from the swelling 24. The beams 2 each may further include a cavity 27 formed or provided in the middle and bottom portion thereof, for receiving the projection 25 of the other beams 2, and for allowing the beams 2 and thus the carriages to be stably stacked or piled together, as shown in FIG. 3.

Figure 3:
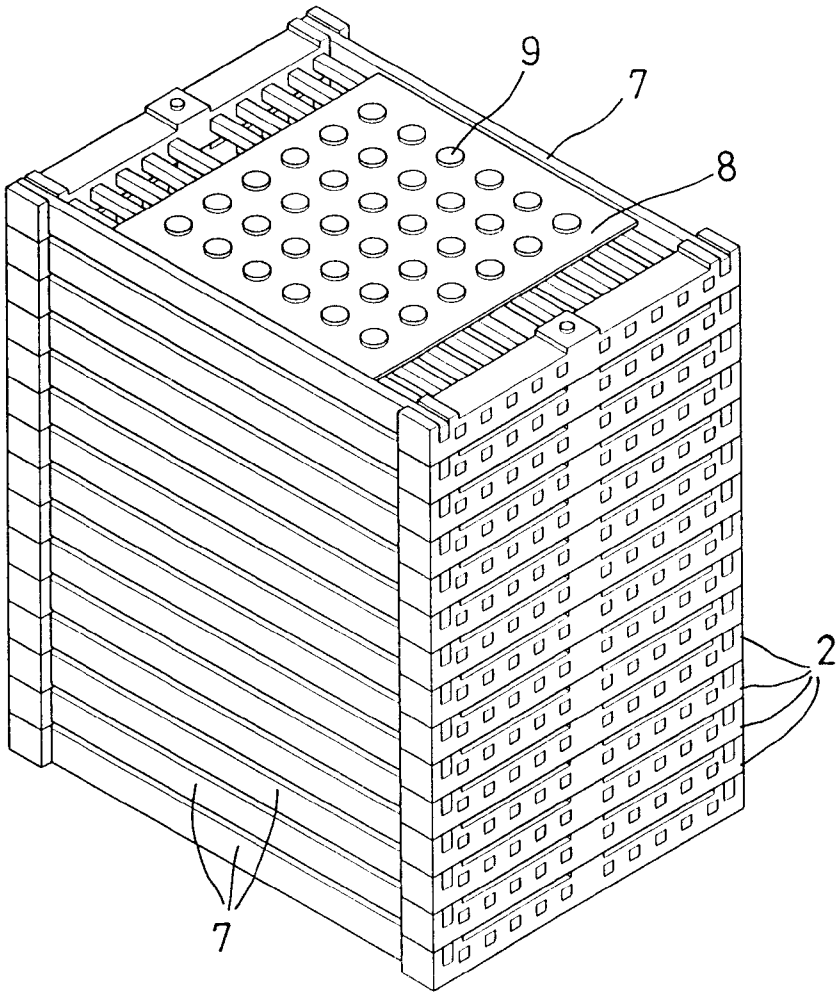
FIG. 3 is a perspective view illustrating a number of carriages that are stacked or piled together.

As shown in FIG. 3, the objects 8 or 9 to be heated by kilns or furnaces may include a plate 8 having a number of protrusions 9 extended upward therefrom, or may include a plate 8 and a number of blocks or protrusions 9 disposed on the plate 8. The other objects or various kinds of objects 8 or 9 may also be supported on the carriage and to be heated by kilns or furnaces.

Figure 4:
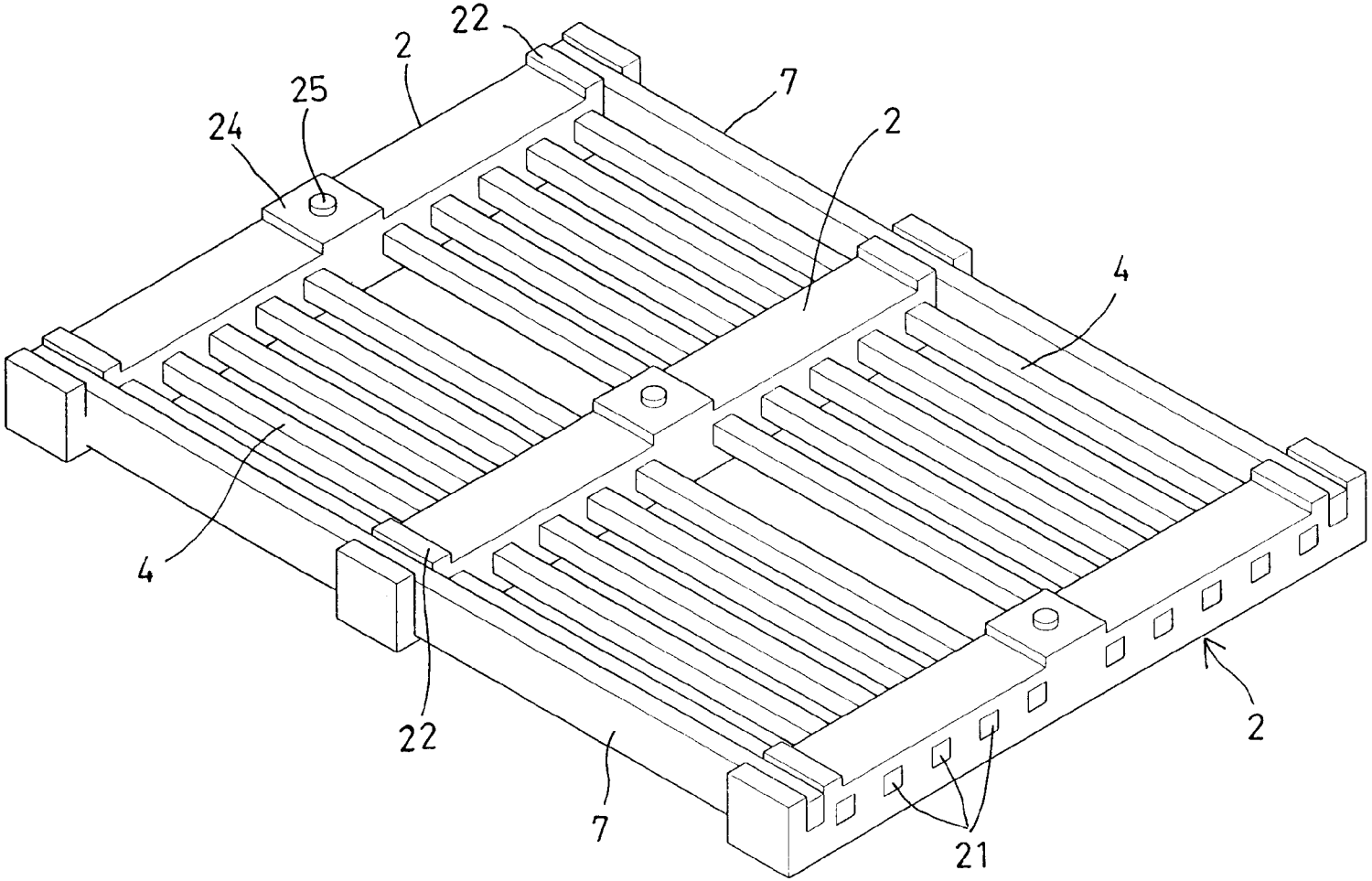
FIG. 4 is a perspective view illustrating the other arrangement or application of the carriage.

Referring next to FIG. 4, one or more beams 2 may further be provided and engaged onto the rods 4, such as engaged onto the middle portions of the rods. Or, relatively, the rods 4 may be engaged through the orifices 21 of one or more of the beams 2, for allowing the beams 2 to be engaged onto the rods 4, and for forming a solid structure to support the objects. The carriage will not be broken, and the working life thereof may thus be greatly increased.

Accordingly, the carriage may be used for stably supporting objects to be heated by kilns or furnaces, and may include an increasing working life.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A carriage for supporting objects to be heated by kilns or furnaces, said carriage comprising:

a pair of beams each including a plurality of orifices formed therein; and a plurality of rods engaged through said orifices of said beams and retained between said beams for supporting the objects;

wherein said beams each include two ends, each end having a groove formed therein, said carriage further includes a pair of bars each having two ends engaged with said beams, and each having an extension extended from each of said ends thereof and engaged into said grooves of said beams.

2. The carriage according to claim 1, wherein said beams each includes two ends each having a bulge extended upwardly therefrom, and having said groove formed in said bulges and facing upwardly for receiving said extensions of said bars.

3. A carriage for supporting objects to be heated by kilns or furnaces, said carriage comprising:

a pair of beams each including a plurality of orifices formed therein; and a plurality of rods engaged through said orifices of said beams and retained between said beams for supporting the objects;

wherein said beams each includes a lower portion having a cavity formed therein, and an upper portion having a projection extended upwardly therefrom for piling purposes.

4. The carriage according to claim 3, wherein said beams each includes a swelling having said projection extended upward from said swelling.

* * * * *